US012747734B2

(12) United States Patent
Takahashi

(10) Patent No.: US 12,747,734 B2
(45) Date of Patent: Sep. 29, 2026

(54) COMPRESSOR

(71) Applicant: MITSUBISHI HEAVY INDUSTRIES COMPRESSOR CORPORATION, Hiroshima (JP)

(72) Inventor: Fugaku Takahashi, Hiroshima (JP)

(73) Assignee: MITSUBISHI HEAVY INDUSTRIES COMPRESSOR CORPORATION, Hiroshima (JP)

( * ) Notice: Subject to any disclaimer, the term of this patent is extended or adjusted under 35 U.S.C. 154(b) by 0 days.

(21) Appl. No.: 19/151,842

(22) PCT Filed: Jan. 23, 2024

(86) PCT No.: PCT/JP2024/001858
§ 371 (c)(1),
(2) Date: Jul. 29, 2025

(87) PCT Pub. No.: WO2024/162099
PCT Pub. Date: Aug. 8, 2024

(65) Prior Publication Data

US 2026/0235136 A1 Aug. 13, 2026

(30) Foreign Application Priority Data

Jan. 31, 2023 (JP) ..... 2023-012459

(51) Int. Cl.
*F04D 29/12* (2006.01)
*F04D 17/10* (2006.01)
*F04D 25/16* (2006.01)

(52) U.S. Cl.
CPC ..... *F04D 29/124* (2013.01); *F04D 17/10* (2013.01); *F04D 25/163* (2013.01)

(58) Field of Classification Search
CPC ..... F01D 25/183; F01D 25/18; F01D 25/16; F01D 25/1862; F05D 2240/50;
(Continued)

(56) References Cited

U.S. PATENT DOCUMENTS 3,971,563 A * 7/1976 Sugimura ..... F16J 15/441 277/413
4,993,917 A * 2/1991 Kulle ..... F01D 3/04 415/105

(Continued)

FOREIGN PATENT DOCUMENTS

JP 6513809 B2 5/2019

OTHER PUBLICATIONS

International Search Report issued for corresponding international patent application No. PCT/JP2024/001858, mailed Apr. 16, 2024 (4 pages).

(Continued)

*Primary Examiner* — Nathaniel E Wiehe
*Assistant Examiner* — Joshua R Beebe
(74) *Attorney, Agent, or Firm* — Osha Bergman Watanabe & Burton LLP

(57) ABSTRACT

A compressor includes: a rotor including a rotor shaft rotatable around an axis and a compression unit that rotates integrally with the rotor shaft and compresses fluid; a casing for covering the rotor from an outer side in a radial direction with the axis as a center; a sealing mechanism for sealing an annular space formed between the rotor shaft and the casing with a sealing gas; a sealing gas supply line for supplying the sealing gas to the annular space; and a gas lead-out line for leading the sealing gas in the annular space to a suction port of the compression unit.

9 Claims, 5 Drawing Sheets

(58) Field of Classification Search
CPC ..... F05D 2240/55; F05D 2260/98; F04D 29/124; F04D 29/12; F04D 17/10; F04D 25/163; F04D 25/16
See application file for complete search history.

(56) References Cited

U.S. PATENT DOCUMENTS

| | | | | |
|---|---|---|---|---|
| 6,524,059 | B1 * | 2/2003 | Nogiwa | F16J 15/3492 415/113 |
| 6,802,689 | B2 * | 10/2004 | Nogiwa | F04D 27/0292 415/113 |
| 9,239,061 | B2 * | 1/2016 | Kitano | F04D 29/124 |
| 2007/0077142 | A1 * | 4/2007 | Schnieders | F04D 29/104 415/170.1 |
| 2007/0147988 | A1 * | 6/2007 | Ito | F01D 11/04 415/169.1 |
| 2013/0259679 | A1 * | 10/2013 | Brailean | F16J 15/008 415/230 |
| 2017/0335966 | A1 | 11/2017 | Werdecker et al. | |
| 2019/0271325 | A1 * | 9/2019 | Masuda | F04D 29/041 |

OTHER PUBLICATIONS

Written Opinion issued for corresponding international patent application No. PCT/JP2024/001858, mailed Apr. 16, 2024 (6 pages).

* cited by examiner

COMPRESSOR

TECHNICAL FIELD

The present disclosure relates to a compressor.

The present application claims priority to JP 2023-012459 filed in Japan on Jan. 31, 2023, the contents of which are incorporated herein by reference.

BACKGROUND ART

In a compressor that compresses a process gas (fluid), there is a structure including an impeller attached to a rotor shaft. Such a compressor compresses fluid supplied from outside through a flow path formed in a casing by the impeller that rotates together with the rotor shaft.

Such a compressor includes a shaft sealing mechanism that prevents the process gas compressed inside the casing from leaking outward through a gap between the rotor shaft and the casing. The shaft sealing mechanism divides an annular space between the rotor shaft and a stator covering an outer peripheral side of the rotor shaft into a high-pressure side and a low-pressure side in an axial direction. For example, Patent Document 1 discloses a configuration including a first seal, a second seal, and a third seal disposed side by side between a product side (inner side) to be sealed and an atmosphere side (outer side). In this configuration, the second seal is disposed between the first seal and the third seal. In this structure, a pressure of a space adjacent to the second seal on one side (the product side) in the axial direction is made equal to a pressure of a space adjacent to the second seal on another side (the atmosphere side) in the axial direction.

CITATION LIST

Patent Literature

Patent Document 1: JP 6513809 B

SUMMARY OF INVENTION

Technical Problem

However, the configuration described in Patent Document 1 requires a mechanism for maintaining a pressure balance between the space on the one side of the second seal in the axial direction and the space on the other side in the axial direction. Therefore, a structure for enhancing a sealing property is complicated.

The present disclosure provides a compressor in which a sealing property in a gap between a rotor shaft and a casing can be enhanced with a simple configuration.

Solution to Problem

A compressor according to the present disclosure includes a rotor including a rotor shaft rotatable around an axis and a compression unit that rotates integrally with the rotor shaft and compresses fluid, a casing for covering the rotor from an outer side in a radial direction with the axis as a center, a sealing mechanism for sealing an annular space formed between the rotor shaft and the casing with a sealing gas, a sealing gas supply line for supplying the sealing gas to the annular space, and a gas lead-out line for leading the sealing gas in the annular space to a suction port of the compression unit, wherein the sealing mechanism includes a first sealing portion, a second sealing portion disposed at an interval from the first sealing portion in an axial direction so as to be separated from the compression unit, and a third sealing portion disposed at an interval from the second sealing portion on a side opposite to the first sealing portion in the axial direction, the second sealing portion has a sealing property stronger than that of either the first sealing portion or the third sealing portion, and includes a carbon ring seal disposed on the outer side in the radial direction with respect to the rotor shaft and extending in a circumferential direction around the axis, the second sealing portion divides the annular space into a high-pressure space close to the first sealing portion in the axial direction with respect to the second sealing portion and a low-pressure space close to the third sealing portion in the axial direction with respect to the second sealing portion and having a pressure lower than that of the high-pressure space between the first sealing portion and the third sealing portion, and the gas lead-out line connects the high-pressure space and a suction port of the compression unit having a pressure lower than that of the low-pressure space to each other.

Advantageous Effects of Invention

According to a compressor of the present disclosure, a sealing property in a gap between a rotor shaft and a casing can be enhanced with a simple configuration.

DESCRIPTION OF EMBODIMENTS

Hereinafter, embodiments for implementing compressors according to the present disclosure will be described with reference to the accompanying drawings. However, the present disclosure is not limited only to these embodiments.

Configuration of Compressor

Figure 1:
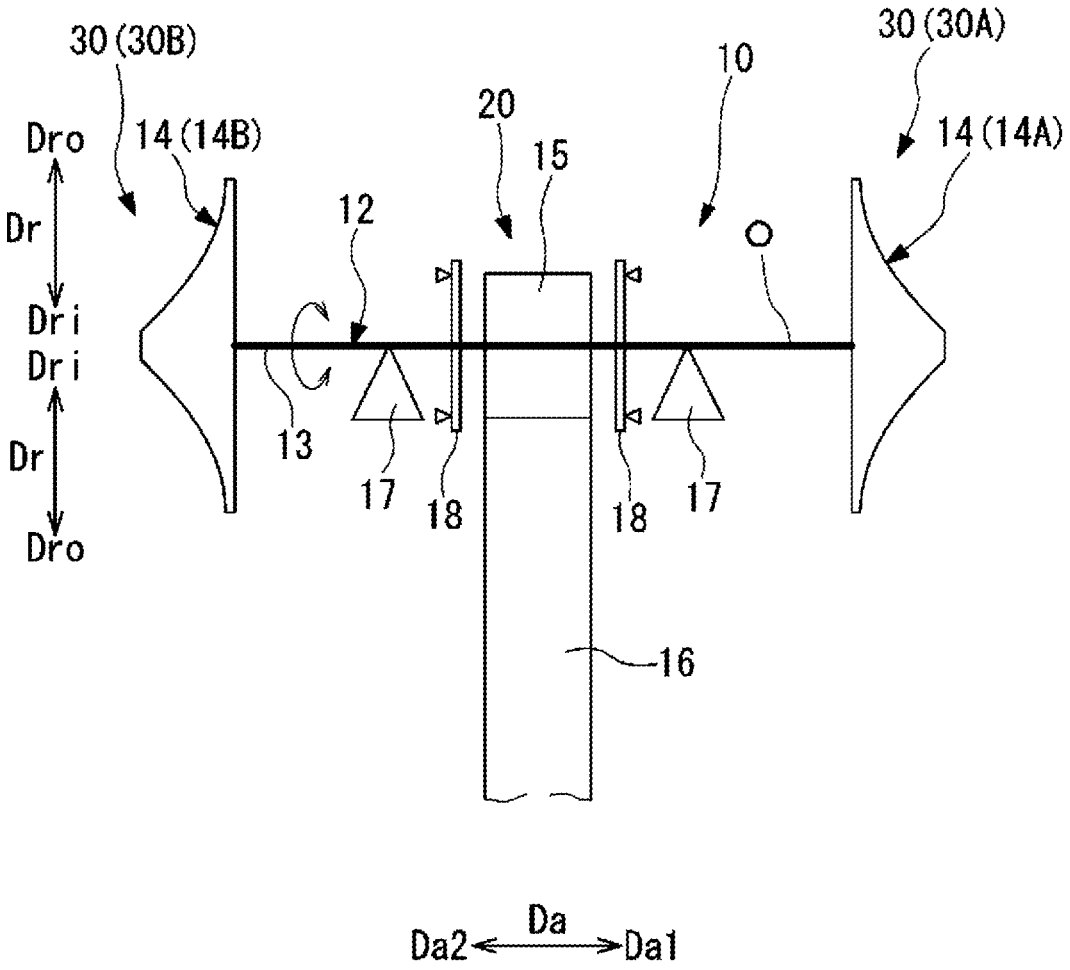
FIG. 1 is a diagram illustrating a schematic configuration of a compressor according to the present embodiment.

As illustrated in FIG. 1, a compressor 10 according to the present embodiment mainly includes a casing 11 (see FIG. 2), a rotor 12, a pinion gear 15, a drive gear 16, a low-pressure stage sealing mechanism (sealing mechanism) 50 (see FIG. 2), and a high-pressure stage sealing mechanism (sealing mechanism) 70. The compressor 10 of the present embodiment is, for example, a geared centrifugal compressor. The compressor 10 compresses fluid. Here, examples of the fluid compressed by the compressor 10 include gases such as carbon dioxide, hydrogen, air, and various corrosive gases.

As illustrated in FIG. 1, the rotor 12 includes a rotor shaft 13 and an impeller 14. The rotor shaft 13 has a columnar shape centered on an axis O. The rotor shaft 13 is made rotatable around the axis O. The rotor shaft 13 is supported by a pair of radial bearings 17 and a thrust bearing 18. The pair of radial bearings 17 are disposed at an interval in an axial direction Da (a direction in which the axis O of the rotor shaft 13 extends) in the casing 11.

The radial bearing 17 is supported by the casing 11. The radial bearing 17 restricts movement of the rotor shaft 13 in a radial direction Dr. The thrust bearing 18 is disposed at a position separated from the pinion gear 15 in the axial direction Da. The thrust bearing 18 restricts movement of the rotor shaft 13 in the axial direction Da.

The impeller 14 is fixed to the rotor shaft 13 at a position separated from the radial bearing 17 in the axial direction Da. The impeller 14 rotates around the axis O integrally with the rotor shaft 13. The impeller 14 of the present embodiment is fixed to an end portion of the rotor shaft 13 outside the pair of radial bearings 17 in the axial direction Da. To be specific, as the impeller 14, a first impeller 14A disposed on a first side Da1 in the axial direction Da with respect to the pinion gear 15 and a second impeller 14B disposed on a second side Da2 in the axial direction Da with respect to the pinion gear 15 are provided.

Figure 2:
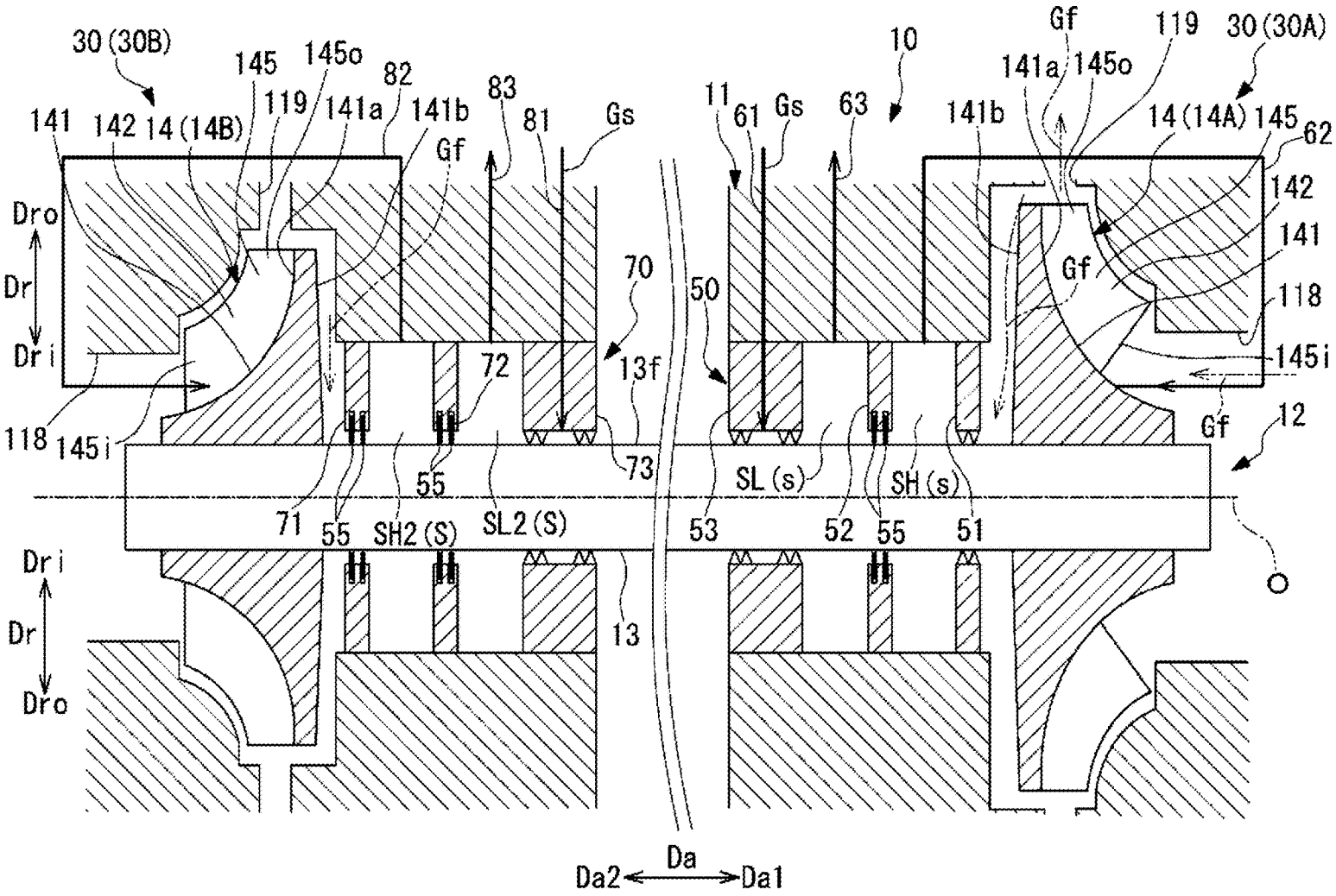
FIG. 2 is a cross-sectional view illustrating a rotor shaft, an impeller, and a sealing mechanism of the compressor according to the present embodiment.

As illustrated in FIG. 2, each impeller 14 (the first impeller 14A and the second impeller 14B) is a so-called open impeller including a disc portion 141 and a blade portion 142 in the present embodiment. Note that the first impeller 14A and the second impeller 14B have configurations similar to each other. Therefore, the first impeller 14A will be described below as an example representatively.

In the first impeller 14A, the disc portion 141 has a disc-like shape centered on the axis O. The disc portion 141 is formed as a concave curved surface in which an outside diameter gradually increases as viewed from a first surface 141*a* on one side in the axial direction Da (the first side in the axial direction Da) of the disc portion 141 toward a second surface 141*b* on another side (the second side in the axial direction Da). A plurality of the blade portions 142 are fixed to the disc portion 141 at intervals in a circumferential direction around the axis O. The plurality of blade portions 142 extend toward the one side in the axial direction Da from the first surface 141*a* which is a surface of the disc portion 141 facing the one side in the axial direction Da.

The disc portion 141 and the blade portion 142 form an impeller flow path 145. The impeller flow path 145 includes a suction port 145*i* that opens toward the one side in the axial direction Da and a discharge port 145*o* that opens outward in the radial direction Dr around the axis O of the impeller 14. That is, the suction port 145*i* is formed on an inner side Dri in the radial direction Dr in the impeller 14. The discharge port 145*o* is formed on an outer side Dro in the radial direction Dr in the impeller 14.

As illustrated in FIG. 1, the pinion gear 15 is disposed between the pair of radial bearings 17 of the rotor shaft 13. That is, the pinion gear 15 is disposed inside the pair of radial bearings 17 in the axial direction Da. The drive gear 16 engages with the pinion gear 15. The drive gear 16 is rotationally driven by an external drive source. The drive gear 16 is set to have a larger outside diameter dimension than that of the pinion gear 15. Thus, a rotational speed of the rotor shaft 13 including the pinion gear 15 is higher than a rotational speed of the drive gear 16.

Such a pinion gear 15 and a drive gear 16 constitute a speed increasing transmission unit 20 that increases the rotational speed of the drive gear 16 by the external drive source via the pinion gear 15 and transmits the rotational speed to the rotor shaft 13.

As illustrated in FIG. 2, the casing 11 forms an outer shell of the compressor 10. The casing 11 covers the rotor 12 from the outer side Dro in the radial direction Dr. The casing 11 of the present embodiment includes an intake flow path 118 and an exhaust flow path 119 formed around the impeller 14. The intake flow path 118 communicates with the suction port 145*i* of the impeller flow path 145. The intake flow path 118 is formed so as to be continuous in the axial direction Da with the suction port 145*i* of the impeller flow path 145. The exhaust flow path 119 communicates with the discharge port 145*o* of the impeller flow path 145. The exhaust flow path 119 is formed on the outer side Dro in the radial direction Dr with respect to the discharge port 145*o* of the impeller flow path 145.

A fluid Gf is taken into the impeller flow path 145 from the intake flow path 118 through the suction port 145*i* by the impeller 14 rotating integrally with the rotor shaft 13. The fluid is compressed while flowing from the suction port 145*i* toward the discharge port 145*o* of the impeller flow path 145. The compressed fluid flows out from the discharge port 145*o* to the outer side Dro in the radial direction Dr to be fed to the exhaust flow path 119. The fluid fed into the exhaust flow path 119 is further compressed while swirling around a circumferential direction Dc along the exhaust flow path 119.

Such an impeller 14, an intake flow path 118, and an exhaust flow path 119 constitute a compression unit 30 that compresses fluid. Accordingly, as illustrated in FIG. 1, the compressor 10 includes a pair of the compression units 30 disposed on both sides in the axial direction Da with the speed increasing transmission unit 20 interposed therebetween. The pair of compression units 30 include a first stage compression unit 30A disposed on the first side Da1 in the axial direction Da with the speed increasing transmission unit 20 interposed therebetween, and a second stage compression unit 30B disposed on the second side Da2 in the axial direction Da with the speed increasing transmission unit 20 interposed therebetween. That is, the compressor 10 is configured as a single-shaft two-stage compressor.

In such a compressor 10, fluid compressed by the first impeller 14A of the first stage compression unit 30A subsequently flows into the second stage compression unit 30B. In the course of flowing through the second impeller 14B of the second stage compression unit 30B, the fluid is further compressed to become a fluid having a higher pressure. That is, the compressor 10 compresses the fluid Gf in a stepwise manner by the plurality of compression units 30. Therefore, in the present embodiment, the first stage compression unit 30A is the compression unit 30 having the lowest pressure among the plurality of compression units 30. Further, the second stage compression unit 30B is the compression unit 30 having the highest pressure among the plurality of compression units 30. The first stage compression unit 30A having the lowest pressure compresses the fluid Gf at a pressure equal to or lower than 100 barG.

Configuration of Low-Pressure Stage Sealing Mechanism

Figure 3:
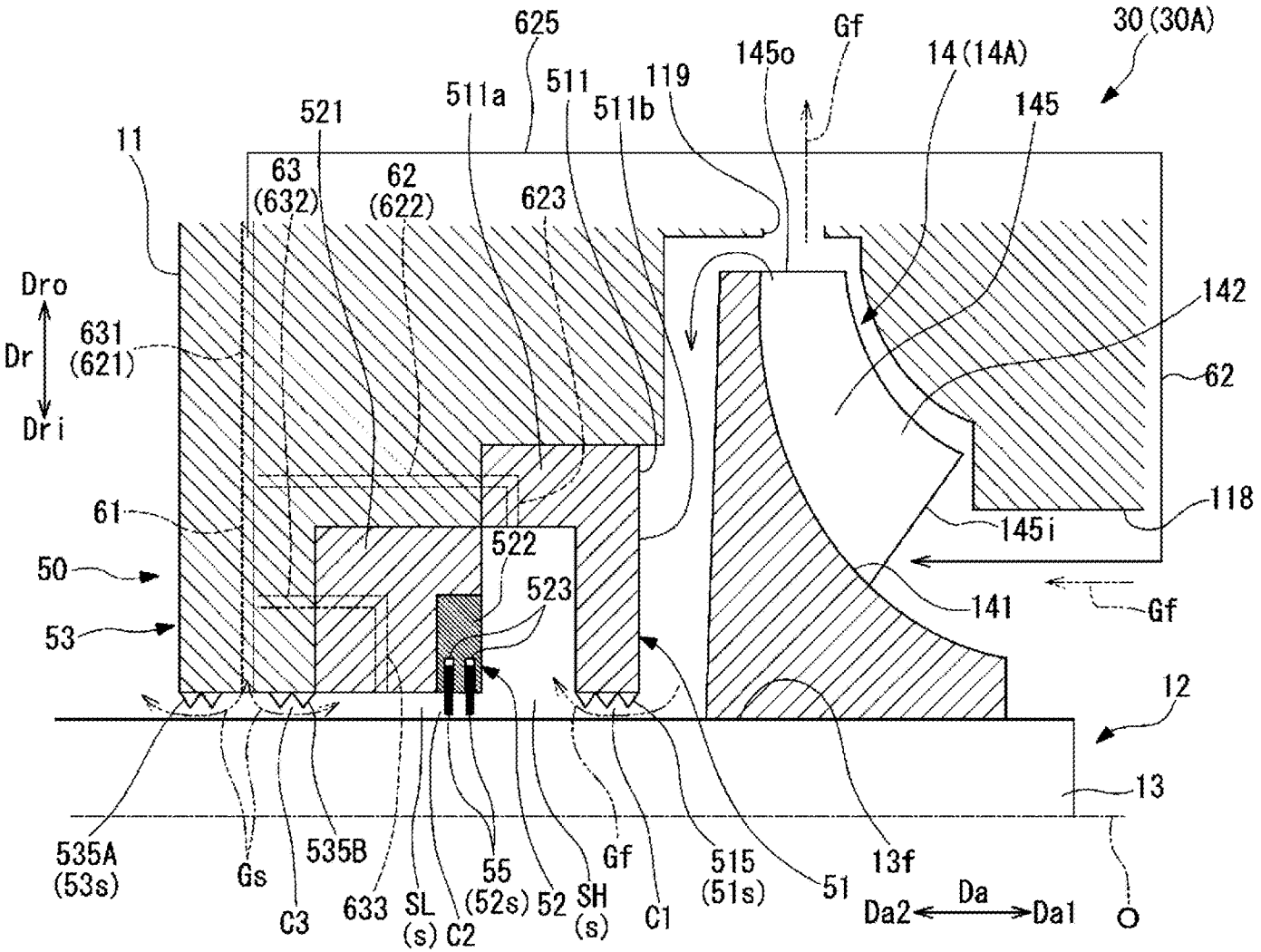
FIG. 3 is a cross-sectional view illustrating a configuration of the sealing mechanism on a low-pressure stage side according to the present embodiment.

As illustrated in FIGS. 2 and 3, a low-pressure stage sealing mechanism 50 is a sealing mechanism for sealing a space between the casing 11 and the rotor shaft 13 with a sealing gas. The low-pressure stage sealing mechanism 50 is disposed at a position closest to the compression unit 30 having the lowest pressure among the plurality of compression units 30 in the axial direction Da. In the present embodiment, the low-pressure stage sealing mechanism 50 is disposed at a position adjacent to the first stage compression unit 30A having the lowest pressure among the plurality of compression units 30 in the axial direction Da.

The low-pressure stage sealing mechanism 50 prevents the fluid Gf from leaking outward from an inside of the casing 11. The low-pressure stage sealing mechanism 50 is disposed at a gap between the casing 11 and the rotor shaft 13. An annular space S is formed between the rotor shaft 13 and the casing 11. The annular space S is formed at a position separated from the impeller 14 in the axial direction Da with respect to the impeller 14. The low-pressure stage sealing mechanism 50 seals the annular space S with a sealing gas Gs.

The low-pressure stage sealing mechanism 50 includes a first low-pressure sealing portion (first sealing portion) 51, a second low-pressure sealing portion (second sealing portion) 52, and a third low-pressure sealing portion (third sealing portion) 53. Each of the first low-pressure sealing portion 51, the second low-pressure sealing portion 52, and the third low-pressure sealing portion 53 is fixed to the casing 11. The first low-pressure sealing portion 51, the second low-pressure sealing portion 52, and the third low-pressure sealing portion 53 are disposed at intervals in the axial direction Da.

The first low-pressure sealing portion 51 is disposed at a position closest to the first impeller 14A among the first low-pressure sealing portion 51, the second low-pressure sealing portion 52, and the third low-pressure sealing portion 53 in the axial direction Da. The second low-pressure sealing portion 52 is disposed at an interval in the axial direction Da so as to be separated from the first stage compression unit 30A with respect to the first low-pressure sealing portion 51. That is, the second low-pressure sealing portion 52 is separated from the first low-pressure sealing portion 51 in the axial direction Da so as to be separated from the compression unit 30. The third low-pressure sealing portion 53 is disposed at an interval on a side opposite to the first low-pressure sealing portion 51 with respect to the second low-pressure sealing portion 52 in the axial direction Da. That is, the third low-pressure sealing portion 53 is disposed at a position farthest from the first impeller 14A among the first low-pressure sealing portion 51, the second low-pressure sealing portion 52, and the third low-pressure sealing portion 53.

The second low-pressure sealing portion 52 divides the annular space S into a high-pressure space SH and a low-pressure space SL having a pressure lower than that of the high-pressure space SH between the first low-pressure sealing portion 51 and the third low-pressure sealing portion 53. The high-pressure space SH is a space divided by the second low-pressure sealing portion 52 and the first low-pressure sealing portion 51 in the axial direction Da. The high-pressure space SH is formed at a position closer to the first low-pressure sealing portion 51 in the axial direction Da with respect to the second low-pressure sealing portion 52. The low-pressure space SL is a space divided by the second low-pressure sealing portion 52 and the third low-pressure sealing portion 53 in the axial direction Da. The low-pressure space SL is formed at a position closer to the third low-pressure sealing portion 53 (a position far from the first impeller 14A) in the axial direction Da with respect to the second low-pressure sealing portion 52.

As illustrated in FIG. 3, the first low-pressure sealing portion 51 extends in the circumferential direction Dc around the axis O so as to be annular. The first low-pressure sealing portion 51 seals the annular space S. In the present embodiment, the first low-pressure sealing portion 51 includes a first base member 511 and a first labyrinth portion 515.

The first base member 511 is fixed to the casing 11. The first base member 511 is an annular block member. To be specific, the first base member 511 includes a base portion 511*a* and an extension portion 511*b*. The base portion 511*a* is fixed to the casing 11 by a bolt or the like. The extension portion 511*b* extends inward in the radial direction Dr from the base portion 511*a* toward the rotor shaft 13.

The first labyrinth portion 515 is fixed to a distal end of the first base member 511. The first labyrinth portion 515 is fixed to the extension portion 511*b* on the inner side Dri in the radial direction Dr. The first labyrinth portion 515 is a labyrinth seal that protrudes from the extension portion 511*b* so as to form a plurality of fin shapes. A distal end of the first labyrinth portion 515 forms a first seal inner peripheral end 51*s* located farthest on the inner side Dri in the radial direction Dr in the first low-pressure sealing portion 51. The first seal inner peripheral end 51*s* is disposed so as to form a minute clearance C1 with respect to an outside surface 13*f* of the rotor shaft 13.

A part of the fluid Gf having a high pressure compressed by the first impeller 14A and discharged from the discharge port 145*o* leaks out from a gap between a rear surface of the first impeller 14A and the casing 11. The leaked fluid Gf flows into the high-pressure space SH from the clearance C1 between the first seal inner peripheral end 51*s* and the outside surface 13*f* of the rotor shaft 13.

The third low-pressure sealing portion 53 extends in the circumferential direction De around the axis O so as to be annular. The third low-pressure sealing portion 53 seals the annular space S. The third low-pressure sealing portion 53 includes a pair of third labyrinth portions 535A and 535B. The pair of third labyrinth portions 535A and 535B are disposed at an interval in the axial direction Da. The pair of third labyrinth portions 535A and 535B are fixed to the casing 11. The pair of third labyrinth portions 535A and 535B are labyrinth seals protruding so as to form a plurality of fin shapes. Distal ends of the pair of third labyrinth portions 535A and 535B form a third seal inner peripheral end 53*s* located farthest on the inner side Dri in the radial direction Dr in the third low-pressure sealing portion 53. The third seal inner peripheral end 53*s* is disposed so as to form a minute clearance C3 with respect to the outside surface 13*f* of the rotor shaft 13 so as to be at substantially the same level as the first low-pressure sealing portion 51.

The second low-pressure sealing portion 52 extends in a circumferential direction around the axis O so as to be annular. The second low-pressure sealing portion 52 seals the annular space S. The second low-pressure sealing portion 52 has a sealing property stronger than that of either the first low-pressure sealing portion 51 or the third low-pressure sealing portion 53. The second low-pressure sealing portion 52 of the present embodiment includes a second base member 521, a seal holder 522, and a carbon ring seal 55.

The second base member 521 is fixed to the casing 11 by a bolt or the like. The second base member 521 is an annular block member. The seal holder 522 is fixed to the second base member 521.

The seal holder 522 is an annular block member smaller than the second base member 521. The seal holder 522 includes an accommodation groove 523. In the seal holder 522, the accommodation groove 523 is formed so as to be recessed toward the outer side Dro in the radial direction Dr from an inside surface facing the outer side Dro in the radial direction Dr. The accommodation groove 523 continuously extends in the circumferential direction Dc around the axis O. In the present embodiment, a pair of the accommodation grooves 523 are formed at an interval in the axial direction Da.

The carbon ring seal 55 is a plate-like member made of carbon resin. The carbon ring seal 55 is formed in an annular shape extending in the circumferential direction De around the axis O when viewed in the axial direction Da. The carbon ring seal 55 has a sealing property stronger than that of a labyrinth seal. The second low-pressure sealing portion 52 includes a plurality of (two in the present embodiment) the carbon ring seals 55. The plurality of carbon ring seals 55 are disposed at intervals in the axial direction Da. Each carbon ring seal 55 is accommodated in one accommodation groove 523. Each carbon ring seal 55 is accommodated in each accommodation groove 523 so as to be displaceable in the radial direction Dr. Such a carbon ring seal 55 is disposed on the outer side Dro with respect to the rotor shaft 13 in the radial direction Dr. A distal end of the carbon ring seal 55 forms a second seal inner peripheral end 52*s* located farthest on the inner side Dri in the radial direction Dr in the second low-pressure sealing portion 52. The second seal inner peripheral end 52*s* is disposed so as to form a minute clearance C2 with respect to the outside surface 13*f* of the rotor shaft 13 so as to be at substantially the same level as the first low-pressure sealing portion 51. The second seal inner peripheral end 52*s* protrudes from the accommodation groove 523 (an inside surface of the second base member 521) toward the inner side Dri in the radial direction Dr.

Further, the clearance C2 between the second seal inner peripheral end 52*s* and the outside surface 13*f* of the rotor shaft 13 is smaller than the clearance C1 between the first seal inner peripheral end 51*s* and the outside surface 13*f* of the rotor shaft 13 and the clearance C3 between the third seal inner peripheral end 53*s* and the outside surface 13*f* of the rotor shaft 13. That is, the carbon ring seal 55 is disposed at a position closer to the outside surface 13*f* of the rotor shaft 13 in the radial direction Dr as compared to the first labyrinth portion 515 and the pair of third labyrinth portions 535A and 535B. In this way, in the second low-pressure sealing portion 52, a sealing property stronger than that of either the first low-pressure sealing portion 51 or the third low-pressure sealing portion 53 is secured.

Further, the compressor 10 further includes a first sealing gas supply line 61, a first gas lead-out line 62, and a first gas discharge line 63.

The first sealing gas supply line 61 supplies the sealing gas Gs to the annular space S. The first sealing gas supply line 61 is connected to the third low-pressure sealing portion 53. The first sealing gas supply line 61 communicates with a middle of the third labyrinth portion 535A and the third labyrinth portion 535B in the axial direction Da. The first sealing gas supply line 61 is formed with a hole penetrating the casing 11 in the radial direction Dr. One end of the first sealing gas supply line 61 opens toward the inner side Dri in the radial direction Dr between the third labyrinth portion 535A and the third labyrinth portion 535B. The first sealing gas supply line 61 supplies the sealing gas Gs from a sealing gas supply source (not illustrated) provided at an outside of the casing 11 to a gap between the third seal inner peripheral end 53*s* and the outside surface 13*f* of the rotor shaft 13. In the present embodiment, for example, nitrogen gas, dry air, or the like is used as the sealing gas Gs. A part of the sealing gas Gs supplied through the first sealing gas supply line 61 flows into the low-pressure space SL from the clearance C3 between the third seal inner peripheral end 53*s* and the outside surface 13*f* of the rotor shaft 13. In addition, a part of the sealing gas Gs supplied through the first sealing gas supply line 61 flows out from the clearance C3 between the third seal inner peripheral end 53*s* and the outside surface 13*f* of the rotor shaft 13 to a space inside the casing 11 in which the pinion gear 15, the drive gear 16, the radial bearing 17, and the thrust bearing 18 are disposed.

The first gas discharge line 63 connects the low-pressure space SL in the low-pressure stage sealing mechanism 50 and the outside of the casing 11 to each other. The first gas discharge line 63 discharges the sealing gas Gs flowing into the low-pressure space SL through the first sealing gas supply line 61 and the fluid Gf leaking out to the low-pressure space SL to the outside of the casing 11. The first gas discharge line 63 of the present embodiment includes a first discharge line 631, a second discharge line 632, and a third discharge line 633.

Figure 4:
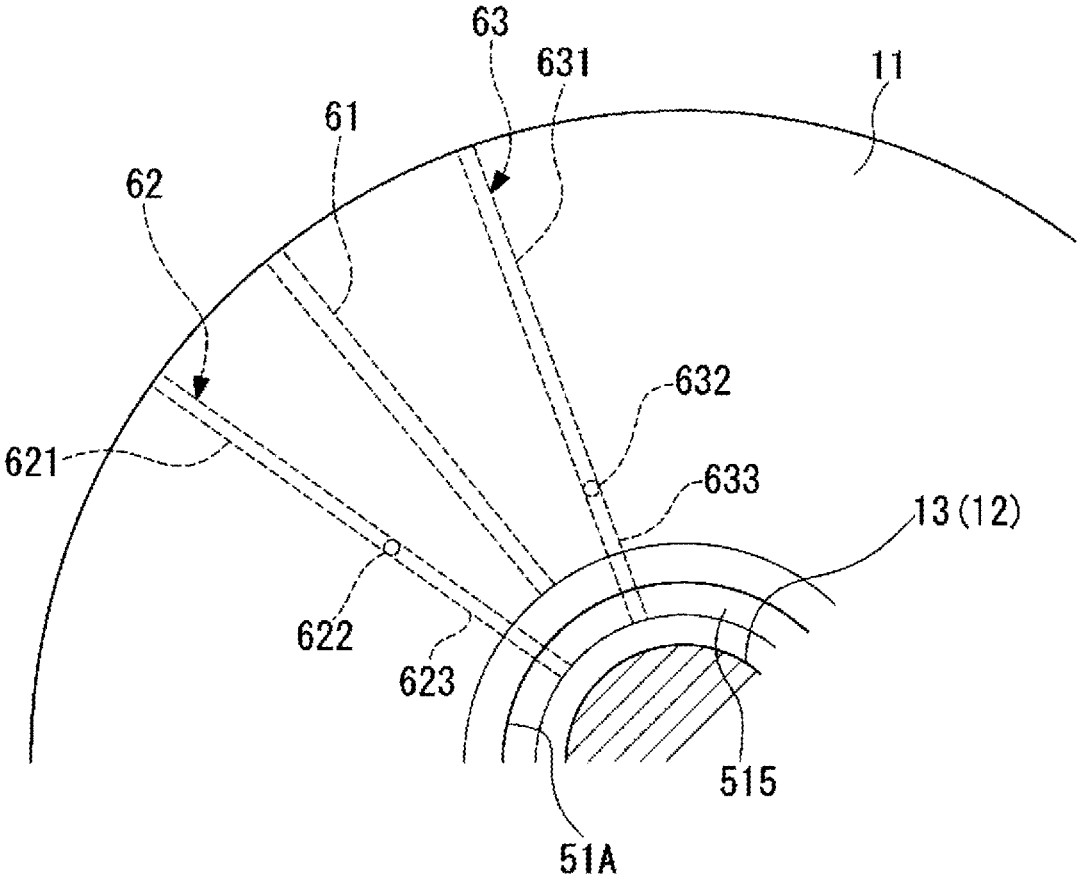
FIG. 4 is a diagram illustrating an example of disposition of a sealing gas supply line, a gas lead-out line, and a gas discharge line formed on the low-pressure stage side according to the present embodiment.

The first discharge line 631 extends from the outside of the casing 11 to the inner side Dri in the radial direction Dr. The first discharge line 631 is disposed at a position overlapping the first sealing gas supply line 61 in the axial direction Da. As illustrated in FIG. 4, the first discharge line 631 is disposed at a different position with respect to the first sealing gas supply line 61 in the circumferential direction Dc when viewed in the axial direction Da.

As illustrated in FIG. 3, the second discharge line 632 extends in the axial direction Da from an inner end portion of the first discharge line 631 in the radial direction Dr so as to approach the second low-pressure sealing portion 52. The third discharge line 633 extends from the second discharge line 632 toward the inner side Dri in the radial direction Dr. The third discharge line 633 opens between the third labyrinth portion 535A and the third labyrinth portion 535B and communicates with the clearance C3.

The first gas lead-out line 62 guides the sealing gas in the annular space S to the suction port 145*i* of the compression unit 30. The first gas lead-out line 62 connects the high-pressure space SH and the suction port 145 *i* of the compression unit 30 having a pressure lower than that of the low-pressure space SL to each other. The first gas lead-out line 62 of the present embodiment is connected to the suction port 145*i* of the first impeller 14A of the first stage compression unit 30A having the lowest pressure. The first gas lead-out line 62 discharges the sealing gas Gs and the fluid Gf flowing into the high-pressure space SH to the suction port 145 *i*. The first gas lead-out line 62 includes a first lead-out line 621, a second lead-out line 622, and a third lead-out line 623.

The first lead-out line 621 extends from the outside of the casing 11 toward the inner side Dri in the radial direction Dr. The first lead-out line 621 is connected to one end of a pipe 625 at the outside of the casing 11. Another end of the pipe 625 is connected to a position facing the suction port 145*i* of the compression unit 30. Accordingly, the first gas lead-out line 62 connects the high-pressure space SH and the first stage compression unit 30A having a pressure lower than that of the low-pressure space SL to each other. The first gas lead-out line 62 is connected to the suction port 145*i* of the first impeller 14A. The first lead-out line 621 is disposed at a position overlapping the first sealing gas supply line 61, and the first discharge line 631 of the first gas discharge line 63 in the axial direction Da. As illustrated in FIG. 4, the first lead-out line 621 is disposed at a different position with respect to the first sealing gas supply line 61 and the first discharge line 631 in the circumferential direction Dc when viewed in the axial direction Da.

As illustrated in FIG. 3, the second lead-out line 622 extends in the axial direction Da from an inner end portion of the first lead-out line 621 in the radial direction Dr so as to approach the first sealing portion 51 along the axial direction Da. The third lead-out line 623 extends from the second lead-out line 622 toward the inner side Dri in the radial direction Dr. The third lead-out line 623 opens between the first low-pressure sealing portion 51 and the second low-pressure sealing portion 52 and communicates with the high-pressure space SH.

Configuration of High-Pressure Stage Sealing Mechanism

The high-pressure stage sealing mechanism 70 is a sealing mechanism for sealing the annular space S between the casing 11 and the rotor shaft 13 with the sealing gas Gs, similarly to the low-pressure stage sealing mechanism 50. As illustrated in FIG. 2, the high-pressure stage sealing mechanism 70 is disposed at a position adjacent to the second stage compression unit 30B having a pressure higher than that of the compression unit 30 having the lowest pressure among the plurality of compression units 30, in the axial direction Da. That is, in the present embodiment, the high-pressure stage sealing mechanism 70 is disposed at a position adjacent to the second stage compression unit 30B having the highest pressure among the plurality of compression units 30 in the axial direction Da. The high-pressure stage sealing mechanism 70 is different from the low-pressure stage sealing mechanism 50 in a direction in which the high-pressure stage sealing mechanism 70 is disposed in the axial direction Da.

The high-pressure stage sealing mechanism 70 includes a first high-pressure sealing portion (first sealing portion) 71, a second high-pressure sealing portion (second sealing portion) 72, and a third high-pressure sealing portion (third sealing portion) 73. Each of the first high-pressure sealing portion 71, the second high-pressure sealing portion 72, and the third high-pressure sealing portion 73 is fixed to the casing 11. The first high-pressure sealing portion 71, the second high-pressure sealing portion 72, and the third high-pressure sealing portion 73 are disposed at intervals in the axial direction Da.

The first high-pressure sealing portion 71 is disposed at a position closest to the second impeller 14B among the first high-pressure sealing portion 71, the second high-pressure sealing portion 72, and the third high-pressure sealing portion 73 in the axial direction Da. In addition, the third high-pressure sealing portion 73 is disposed at a position farthest from the second impeller 14B among the first high-pressure sealing portion 71, the second high-pressure sealing portion 72, and the third high-pressure sealing portion 73. That is, in the axial direction Da, the arrangement of the first high-pressure sealing portion 71, the second high-pressure sealing portion 72, and the third high-pressure sealing portion 73 is opposite to the arrangement of the first low-pressure sealing portion 51, the second low-pressure sealing portion 52, and the third low-pressure sealing portion 53.

In the present embodiment, the first high-pressure sealing portion 71 includes the carbon ring seal 55 having a similar configuration to that of the second low-pressure sealing portion 52. In the first high-pressure sealing portion 71, two carbon ring seals 55 are disposed at an interval in the axial direction Da.

The second high-pressure sealing portion 72 and the third high-pressure sealing portion 73 of the present embodiment have the same configurations as those of the second low-pressure sealing portion 52 and the third low-pressure sealing portion 53. That is, the second high-pressure sealing portion 72 includes the carbon ring seal 55. Further, the third high-pressure sealing portion 73 does not include the carbon ring seal 55, but includes a labyrinth seal.

The compressor 10 further includes a second sealing gas supply line 81, a second gas lead-out line 82, and a second gas discharge line 83.

The second sealing gas supply line 81 supplies the sealing gas Gs to the annular space S. The second sealing gas supply line 81 is connected to the third high-pressure sealing portion 73. The second sealing gas supply line 81 is connected to a sealing gas supply source (not illustrated) provided at the outside of the casing 11, similarly to the first sealing gas supply line 61. The second sealing gas supply line 81 has a configuration similar to that of the first sealing gas supply line 61 except that the second sealing gas supply line 81 is connected to the third high-pressure sealing portion 73.

The second gas discharge line 83 connects a low-pressure space SL2 in the high-pressure stage sealing mechanism 70 and the outside of the casing 11 to each other. The second gas discharge line 83 has a configuration similar to that of the first gas discharge line 63 except for the connection destinations.

The second gas lead-out line 82 connects a high-pressure space SH2 in the high-pressure stage sealing mechanism 70 and the suction port 145*i* of the second stage compression unit 30B having a pressure lower than that of the low-pressure space SL2 to each other. The second gas lead-out line 82 discharges the sealing gas Gs and the fluid Gf flowing into the high-pressure space SH2 to the suction port 145 *i*. The second gas lead-out line 82 has a configuration similar to that of the first gas lead-out line 62 except for the connection destinations.

Actions and Effects

In the compressor 10 as described above, the annular space S formed between the rotor shaft 13 and the casing 11 is sealed with the sealing gas Gs in the low-pressure stage sealing mechanism 50. A part of the fluid Gf compressed by the first impeller 14A is discharged from the discharge port 145*o*, and then leaks out to the annular space S from the gap between the rear surface of the first impeller 14A and the casing 11. The leaked fluid Gf flows into the high-pressure space SH from the clearance C1 between the first seal inner peripheral end 51*s* and the outside surface 13*f* of the rotor shaft 13. Here, since the second low-pressure sealing portion 52 includes the carbon ring seal 55, the sealing property in the second low-pressure sealing portion 52 is enhanced to be stronger than the sealing property in either the first low-pressure sealing portion 51 or the third low-pressure sealing portion 53. Therefore, the fluid Gf is prevented from leaking out from the high-pressure space SH to the low-pressure space SL beyond the second low-pressure sealing portion 52. Further, the sealing gas Gs is supplied to the low-pressure space SL of the annular space S by the first sealing gas supply line 61. Therefore, the fluid Gf leaking out to the low-pressure space SL beyond the second low-pressure sealing portion 52 is prevented from leaking out from the low-pressure space SL beyond the third low-pressure sealing portion 53. Further, the first gas lead-out line 62 connects the high-pressure space SH and the suction port 145*i* of the first impeller 14A to each other. Accordingly, the sealing gas Gs (fluid Gf) in the high-pressure space SH is pulled out toward the suction port 145*i* of the compression unit 30 having a pressure lower than that of the low-pressure space SL through the first gas lead-out line 62 due to a pressure difference. Therefore, necessity of providing a suction mechanism such as an ejector in order to pull out the fluid Gf in the high-pressure space SH is also reduced.

In this manner, by enhancing the sealing property of the second low-pressure sealing portion 52 that divides the annular space S into the high-pressure space SH and the low-pressure space SL, the fluid Gf in the casing 11 is prevented from leaking out to the outside of the casing 11. Further, since the high-pressure space SH having the sealing property enhanced by the second low-pressure sealing portion 52 and the suction port 145*i* are connected to each other by the first gas lead-out line 62, a sealing property in a gap between the rotor shaft 13 and the casing 11 can be enhanced with a simple configuration.

Further, the clearance C2 between the second seal inner peripheral end 52*s* and the outside surface 13*f* of the rotor shaft 13 is made smaller than either the clearance C1 or the clearance C3. Accordingly, the sealing property of the second low-pressure sealing portion 52 can be further enhanced with respect to the sealing property of either the first low-pressure sealing portion 51 or the third low-pressure sealing portion 53. Therefore, the fluid Gf is further prevented from leaking out from the high-pressure space SH to the low-pressure space SL beyond the second low-pressure sealing portion 52.

Further, the compression unit 30 includes the first impeller 14A disposed on the outer side Dro in the radial direction Dr of the rotor shaft 13. Then, the first gas lead-out line 62 connects the high-pressure space SH and the suction port 145*i* of the first impeller 14A to each other. Accordingly, in the compressor 10 including the first impeller 14A, the high-pressure space SH and the suction port 145*i* of the first impeller 14A, which has a pressure lower than that of the high-pressure space SH and does not cause a loss even when the fluid Gf is discharged, are connected to each other. Therefore, the fluid Gf in the high-pressure space SH can be stably discharged through the first gas lead-out line 62 while suppressing loss.

In addition, the low-pressure stage sealing mechanism 50 is disposed at a position adjacent to the first stage compression unit 30A having the lowest pressure among the plurality of compression units 30 in the axial direction Da. In addition, the first gas lead-out line 62 is connected to the suction port 145 *i* of the first impeller 14A. Accordingly, in the compressor 10 including the plurality of compression units 30, the fluid Gf is prevented from leaking out from the first stage compression unit 30A. In addition, since the first gas lead-out line 62 is connected to the suction port 145 *i* of the first impeller 14A, the fluid Gf in the high-pressure space SH can be returned to the suction port 145*i* of the first impeller 14A. Therefore, the fluid Gf returned from the high-pressure space SH can be compressed again by the first impeller 14A. Therefore, it is possible to further suppress a loss due to the fluid Gf leaking out to the high-pressure space SH.

In addition, the first stage compression unit 30A having the lowest pressure among the plurality of compression units 30 compresses the fluid Gf at a pressure equal to or lower than 100 barG. That is, at the discharge port 145*o* of the first stage compression unit 30A, the fluid Gf after being compressed has a pressure equal to or lower than 100 barG. In this way, in the low-pressure stage sealing mechanism 50 disposed at a position close to the first stage compression unit 30A equal to or lower than 100 barG, the sealing property of the second low-pressure sealing portion 52 is enhanced, thus a sealing property of the compressor 10 including the plurality of compression units 30 as a whole can be enhanced while suppressing costs.

Further, the second low-pressure sealing portion 52 includes the plurality of carbon ring seals 55. Therefore, the sealing property in the second low-pressure sealing portion 52 can be further enhanced. In this way, by increasing the number of carbon ring seals 55 in the second low-pressure sealing portion 52, it is possible to easily enhance the sealing property in the second low-pressure sealing portion 52 while maintaining the clearance C2 between the carbon ring seal 55 and the rotor shaft 13.

Additionally, at least a part of the first sealing gas supply line 61, at least a part of the first gas lead-out line 62, and at least a part of the first gas discharge line 63 are disposed at positions overlapping each other in the axial direction Da. Accordingly, spaces required in the axial direction Da when each of a part of the first sealing gas supply line 61, a part of the first gas lead-out line 62, and a part of the first gas discharge line 63 is formed at the casing 11 are suppressed. Therefore, the spaces in the axial direction Da can be reduced, and the first sealing gas supply line 61, the first gas lead-out line 62, and the first gas discharge line 63 can be formed with a simpler configuration.

Further, the effects obtained by the low-pressure stage sealing mechanism 50 as described above can also be obtained by the high-pressure stage sealing mechanism 70. Further, in the high-pressure stage sealing mechanism 70, not only the second high-pressure sealing portion 72 but also the first high-pressure sealing portion 71 includes the carbon ring seal 55. Therefore, a sealing property of the first high-pressure sealing portion 71 can be enhanced. Therefore, even in the high-pressure stage sealing mechanism 70 disposed adjacent to the second stage compression unit 30B having a pressure higher than that of the first stage compression unit 30A in the axial direction Da, a stable sealing property can be ensured.

Other Embodiments

Although the embodiment of the present disclosure has been described in detail with reference to the accompanying drawings, specific configurations are not limited to the embodiment, and design changes and the like without departing from the gist of the present disclosure are also included.

Figure 5:
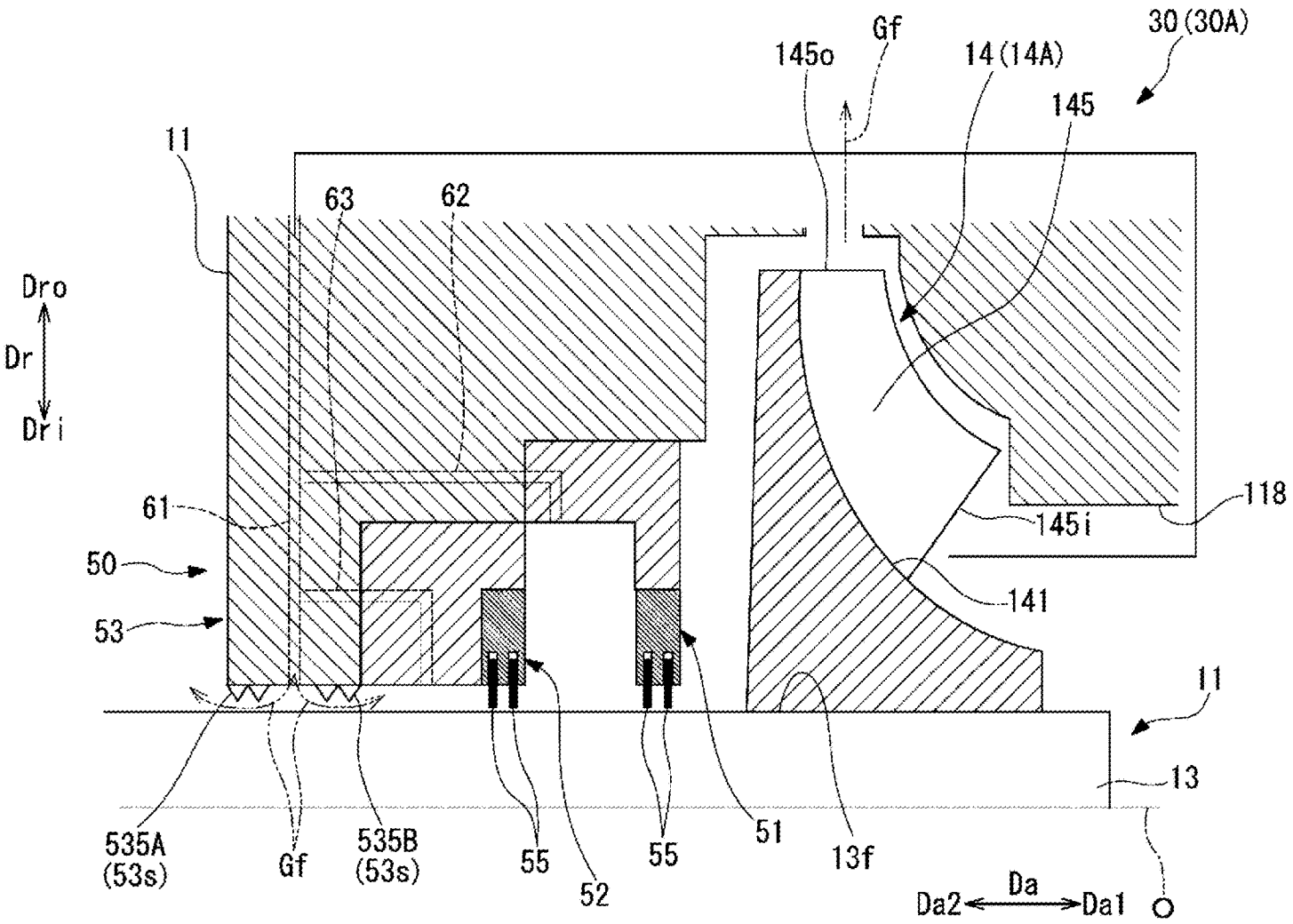
FIG. 5 is a cross-sectional view illustrating a configuration of a sealing mechanism on a low-pressure stage side according to a modification example of the present embodiment.

For example, in the above-described embodiment, the low-pressure stage sealing mechanism 50 is configured to include the carbon ring seal 55 only in the second low-pressure sealing portion 52 among the first low-pressure sealing portion 51, the second low-pressure sealing portion 52, and the third low-pressure sealing portion 53, but the present invention is not limited to such a configuration, and for example, as illustrated in FIG. 5, the low-pressure stage sealing mechanism 50 may include the carbon ring seal 55 in the first low-pressure sealing portion 51 in addition to the second low-pressure sealing portion 52, similarly to the high-pressure stage sealing mechanism 70. At this time, in the first low-pressure sealing portion 51, two carbon ring seals 55 may be disposed at an interval in the axial direction Da.

With such a configuration, the sealing property of the first low-pressure sealing portion 51 can be enhanced. Therefore, it is possible to secure a more stable sealing property by the low-pressure stage sealing mechanism 50 disposed adjacent to the first stage compression unit 30A in the axial direction Da.

In addition, even in a case where the first low-pressure sealing portion 51 does not include the carbon ring seal 55, the first low-pressure sealing portion 51 may include a plurality of seals separated from each other in the axial direction Da. That is, in the first low-pressure sealing portion 51, a plurality of other seals such as labyrinth seals may be disposed at intervals in the axial direction Da instead of the carbon ring seal 55, for example. Even with such a configuration, the sealing property of the first low-pressure sealing portion 51 can be enhanced.

Further, the first low-pressure sealing portion 51 is not limited to the structure including the first base member 511. The first low-pressure sealing portion 51 may have a structure in which the first base member 511 is not provided and the first labyrinth portion 515 and the carbon ring seal 55 are disposed at the casing 11.

Further, the second low-pressure sealing portion 52 is not limited to the structure including the second base member 521 and the seal holder 522. The second low-pressure sealing portion 52 may have a structure in which the second base member 521 and the seal holder 522 are not provided and the carbon ring seal 55 is disposed at the casing 11.

Further, the number of carbon ring seals 55 disposed at the second low-pressure sealing portion 52 or the second high-pressure sealing portion 72 is not limited to two. The number of carbon ring seals 55 disposed at the second low-pressure sealing portion 52 or the second high-pressure sealing portion 72 may be only one, or may be three or more.

In addition, in the embodiment described above, the compressor 10 has the configuration including the one-shaft two-stage compression units 30, but the present invention is not limited thereto. For example, in a configuration including the compression units 30 having two or more shafts at three or more stages, the compression units 30 at one, two, or more stages on a low-pressure stage side may be provided with the sealing mechanisms 50 similar to the above.

In addition, in the above embodiment, the geared centrifugal compressor is illustrated as the compressor 10, but the present invention is not limited thereto. For example, the compressor 10 may be a single-shaft multistage compressor, an axial flow compressor, or the like. When the compressor 10 is a single-shaft multistage compressor, an axial flow compressor, or the like, both of sealing mechanisms provided at both end portions of a rotor shaft in an axial direction may have configurations similar to the above.

Supplementary Notes

The compressor 10 described in each embodiment is grasped as follows, for example.

(1) The compressor 10 according to a first aspect includes the rotor 12 including the rotor shaft 13 rotatable around the axis O and the compression unit 30 that rotates integrally with the rotor shaft 13 and compresses the fluid Gf, the casing 11 for covering the rotor 12 from the outer side Dro in the radial direction Dr with the axis O as the center, the sealing mechanism 50 for sealing the annular space S formed between the rotor shaft 13 and the casing 11 with the sealing gas Gs, the sealing gas supply line 61 for supplying the sealing gas Gs to the annular space S, and the gas lead-out line 62 for leading the sealing gas Gs in the annular space S to the suction port 145*i* of the compression unit 30, wherein the sealing mechanism 50 includes the first sealing portion 51, the second sealing portion 52 disposed at an interval from the first sealing portion 51 in the axial direction Da so as to be separated from the compression unit 30, and the third sealing portion 53 disposed at an interval from the second sealing portion 52 on the side opposite to the first sealing portion 51 in the axial direction Da, the second sealing portion 52 has the sealing property stronger than that of either the first sealing portion 51 or the third sealing portion 53, and includes the carbon ring seal 55 disposed on the outer side Dro in the radial direction Dr with respect to the rotor shaft 13 and extending in the circumferential direction Dc around the axis O, the second sealing portion 52 divides the annular space S into the high-pressure space SH close to the first sealing portion 51 in the axial direction Da with respect to the second sealing portion 52 and the low-pressure space SL close to the third sealing portion 53 in the axial direction Da with respect to the second sealing portion 52 and having a pressure lower than that of the high-pressure space SH between the first sealing portion 51 and the third sealing portion 53, and the gas lead-out line 62 connects the high-pressure space SH and the suction port 145 *i* of the compression unit 30 having a pressure lower than that of the low-pressure space SL to each other.

Examples of the compressor 10 include a geared centrifugal compressor, a multi-stage centrifugal compressor, and an axial flow compressor.

Accordingly, the fluid Gf is prevented from leaking out from the high-pressure space SH to the low-pressure space SL beyond the second sealing portion 52. Further, the low-pressure space SL of the annular space S is supplied with the sealing gas Gs by the sealing gas supply line 61. Therefore, the fluid Gf leaking out to the low-pressure space SL beyond the second sealing portion 52 is prevented from leaking out from the low-pressure space SL beyond the third sealing portion 53. Further, the gas lead-out line 62 connects the high-pressure space SH and the suction port 145*i* of the impeller 14A to each other. Accordingly, the sealing gas Gs (fluid Gf) in the high-pressure space SH is pulled out toward the suction port 145*i* of the compression unit 30 having a pressure lower than that of the low-pressure space SL through the gas lead-out line 62 due to a pressure difference. Therefore, necessity of providing a suction mechanism such as an ejector in order to pull out the fluid Gf in the high-pressure space SH is also reduced. In this manner, by enhancing the sealing property of the second sealing portion 52 that divides the annular space S into the high-pressure space SH and the low-pressure space SL, the fluid Gf in the casing 11 is prevented from leaking out to the outside of the casing 11. Further, since the high-pressure space SH having the sealing property enhanced by the second sealing portion 52 and the suction port 145*i* are connected to each other by the gas lead-out line 62, the sealing property in the gap between the rotor shaft 13 and the casing 11 can be enhanced with a simple configuration.

(2) The compressor 10 according to a second aspect is the compressor 10 of (1), wherein the clearance C2 between the second seal inner peripheral end 52*s* on the inner side Dri in the radial direction Dr in the second sealing portion 52 and the outside surface 13*f* of the rotor shaft 13 is smaller than either the clearance C1 between the first seal inner peripheral end 51*s* on the inner side Dri in the radial direction Dr in the first sealing portion 51 and the outside surface 13*f* of the rotor shaft 13, or the clearance C3 between the third seal inner peripheral end 53*s* on the inner side Dri in the radial direction Dr in the third sealing portion 53 and the outside surface 13*f* of the rotor shaft 13.

Accordingly, the sealing property of the second sealing portion 52 can be further enhanced with respect to the sealing property of either the first sealing portion 51 or the third sealing portion 53. Therefore, the fluid Gf is further prevented from leaking out from the high-pressure space SH to the low-pressure space SL beyond the second sealing portion 52.

(3) The compressor 10 according to a third aspect is the compressor 10 of (1) or (2), wherein the compression unit 30 includes the impeller 14A disposed on the outer side Dro in the radial direction Dr of the rotor shaft 13, and the gas lead-out line 62 connects the high-pressure space SH and the suction port 145*i* of the impeller 14A to each other.

Accordingly, in the compressor 10 including the impeller 14A, the high-pressure space SH and the suction port 145*i* of the impeller 14A, which has a pressure lower than that of the high-pressure space SH and does not cause a loss even when the fluid Gf is discharged, are connected to each other.

Therefore, the fluid Gf in the high-pressure space SH can be stably discharged through the gas lead-out line 62 while suppressing loss.

(4) The compressor 10 according to a fourth aspect is the compressor 10 of (3) including a plurality of the compression units 30, wherein the fluid Gf is sequentially compressed by the plurality of compression units 30, the sealing mechanism 50 is disposed at a position adjacent to the compression unit 30 having the lowest pressure among the plurality of compression units 30 in the axial direction Da, and the gas lead-out line 62 is connected to the suction port 145*i* of the impeller 14A of the compression unit 30 having the lowest pressure.

Accordingly, in the compressor 10 including the plurality of compression units 30, the fluid Gf is prevented from leaking out from the compression unit 30A having the lowest pressure. In addition, since the gas lead-out line 62 is connected to the suction port 145 *i* of the impeller 14A of the compression unit 30A having the lowest pressure, the fluid Gf in the high-pressure space SH can be returned to the suction port 145*i* of the impeller 14A of the compression unit 30A having the lowest pressure. Therefore, the fluid Gf returned from the high-pressure space SH can be compressed again by the impeller 14A of the compression unit 30A having the lowest pressure. Therefore, it is possible to further suppress a loss due to the fluid Gf leaking out to the high-pressure space SH.

(5) The compressor 10 according to a fifth aspect is the compressor 10 of any one of (1) to (4), wherein the compression unit 30 having the lowest pressure compresses the fluid Gf at a pressure equal to or lower than 100 barG.

According to such a configuration, in the sealing mechanism 50 disposed at a position close to the compression unit 30A having the lowest pressure equal to or lower than 100 barG, the sealing property of the second sealing portion 52 is enhanced, thus a sealing property of the compressor 10 including the plurality of compression units 30 as a whole can be enhanced while suppressing costs.

(6) The compressor 10 according to a sixth aspect is the compressor 10 of any one of (1) to (5), wherein the second sealing portion 52 includes a plurality of the carbon ring seals 55.

According to such a configuration, the sealing property of the second sealing portion 52 can be further enhanced. In this way, by increasing the number of carbon ring seals 55 in the second sealing portion 52, it is possible to easily enhance the sealing property in the second sealing portion 52 while maintaining the clearance C2 between the carbon ring seal 55 and the rotor shaft 13.

(7) The compressor 10 according to a seventh aspect is the compressor 10 of any one of (1) to (6), wherein the first sealing portion 51 includes the carbon ring seal 55 that is disposed on the outer side Dro in the radial direction Dr with respect to the rotor shaft 13 and extends in the circumferential direction Dc around the axis O.

According to such a configuration, the sealing property of the first sealing portion 51 can be enhanced. Therefore, it is possible to secure a more stable sealing property by the sealing mechanism 50 disposed adjacent to the compression unit 30A in the axial direction Da.

(8) The compressor 10 according to an eighth aspect is the compressor 10 of any one of (1) to (7) further including the gas discharge line 63 for connecting the low-pressure space SL and the outside of the casing 11 to each other, wherein at least a part of the gas lead-out line 62, at least a part of the gas discharge line 63, and at least a part of the sealing gas supply line 61 are disposed at positions overlapping each other in the axial direction Da.

According to such a configuration, spaces required in the axial direction Da when each of a part of the sealing gas supply line 61, a part of the gas lead-out line 62, and a part of the gas discharge line 63 is formed at the casing 11 are suppressed. Therefore, the spaces in the axial direction Da can be reduced, and the sealing gas supply line 61, the gas lead-out line 62, and the gas discharge line 63 can be formed with a simpler configuration.

(9) The compressor 10 according to a ninth aspect is the compressor 10 of any one of (1) to (8), wherein the first sealing portion 51 may include a plurality of seals separated from each other in the axial direction Da.

Accordingly, the sealing property of the first sealing portion 51 can be enhanced.

INDUSTRIAL APPLICABILITY

According to a compressor of the present disclosure, a sealing property in a gap between a rotor shaft and a casing can be enhanced with a simple configuration.

REFERENCE SIGNS LIST

10 Compressor
11 Casing
11*f* to 11*h* Surface
118 Intake flow path
119 Exhaust flow path
12 Rotor
13 Rotor shaft
13*f* Outside surface
14 Impeller
14A First impeller
14B Second impeller
141 Disc portion
141*a* First surface
141*b* Second surface
142 Blade portion
145 Impeller flow path
145*i* Suction port
145*o* Discharge port
15 Pinion gear
16 Drive gear
17 Radial bearing
18 Thrust bearing
20 Speed increasing transmission unit
30 Compression unit
30A First stage compression unit
30B Second stage compression unit

50 Low-pressure stage sealing mechanism (sealing mechanism)
51 First low-pressure sealing portion (first sealing portion)
51*s* First seal inner peripheral end
511 First base member
511*a* Base portion
511*b* Extension portion
515 First labyrinth portion
52 Second low-pressure sealing portion (second sealing portion)
52*s* Second seal inner peripheral end
521 Second base member
522 Seal holder
523 Accommodation groove
53 Third low-pressure sealing portion (third sealing portion)
53*s* Third seal inner peripheral end
535A, 535B Third labyrinth portion
55 Carbon ring seal
61 First sealing gas supply line (sealing gas supply line)
62 First gas lead-out line (gas lead-out line)
621 First lead-out line
622 Second lead-out line
623 Third lead-out line
625 Pipe
63 First gas discharge line (gas discharge line)
631 First discharge line
632 Second discharge line
633 Third discharge line
70 High-pressure stage sealing mechanism (sealing mechanism)
71 First high-pressure sealing portion
72 Second high-pressure sealing portion
73 Third high-pressure sealing portion
81 Second sealing gas supply line
82 Second gas lead-out line
83 Second gas discharge line
C1 to C3 Clearance
Da Axial direction
Da1 First side
Da2 Second side
Dc Circumferential direction
Dr Radial direction
Dri Inner side
Dro Outer side
Gf Fluid
Gs Sealing gas
O Axis
S Annular space
SH, SH2 High-pressure space
SL, SL2 Low-pressure space

The invention claimed is:

1. A compressor, comprising:

a rotor including a rotor shaft rotatable around an axis and a compression unit that rotates integrally with the rotor shaft and compresses fluid;

a casing for covering the rotor from an outer side in a radial direction with the axis as a center;

a sealing mechanism for sealing an annular space formed between the rotor shaft and the casing with a sealing gas;

a sealing gas supply line for supplying the sealing gas to the annular space; and a gas lead-out line for leading the sealing gas in the annular space to a suction port of the compression unit, wherein the sealing mechanism includes a first sealing portion, a second sealing portion disposed at an interval from the first sealing portion in an axial direction so as to be separated from the compression unit, and a third sealing portion disposed at an interval from the second sealing portion on a side opposite to the first sealing portion in the axial direction, the second sealing portion has a sealing property stronger than that of either the first sealing portion or the third sealing portion, and includes a carbon ring seal disposed on the outer side in the radial direction with respect to the rotor shaft and extending in a circumferential direction around the axis, the second sealing portion divides the annular space into a high-pressure space close to the first sealing portion in the axial direction with respect to the second sealing portion and a low-pressure space close to the third sealing portion in the axial direction with respect to the second sealing portion and having a pressure lower than that of the high-pressure space between the first sealing portion and the third sealing portion, and the gas lead-out line connects the high-pressure space and a suction port of the compression unit having a pressure lower than that of the low-pressure space to each other.

2. The compressor according to claim 1, wherein a clearance between a second seal inner peripheral end on an inner side in the radial direction in the second sealing portion and an outside surface of the rotor shaft is smaller than either a clearance between a first seal inner peripheral end on the inner side in the radial direction in the first sealing portion and the outside surface of the rotor shaft or a clearance between a third seal inner peripheral end on the inner side in the radial direction in the third sealing portion and the outside surface of the rotor shaft.

3. The compressor according to claim 1, wherein the compression unit includes an impeller disposed on the outer side in the radial direction of the rotor shaft, and the gas lead-out line connects the high-pressure space and a suction port of the impeller to each other.

4. The compressor according to claim 3, further comprising a plurality of compression units, wherein the fluid is sequentially compressed by the plurality of compression units, the sealing mechanism is disposed at a position adjacent to the compression unit having a lowest pressure among the plurality of compression units in the axial direction, and the gas lead-out line is connected to the suction port of the impeller of the compression unit having the lowest pressure.

5. The compressor according to claim 4, wherein the compression unit having the lowest pressure compresses the fluid at a pressure equal to or lower than 100 barG.

6. The compressor according to claim 1, wherein the second sealing portion includes a plurality of the carbon ring seals.

7. The compressor according to claim 1, wherein the first sealing portion includes a carbon ring seal disposed on the outer side in the radial direction with respect to the rotor shaft and extending in the circumferential direction around the axis.

8. The compressor according to claim 1, further comprising a gas discharge line for connecting the low-pressure space and an outside of the casing to each other, wherein at least a part of the gas lead-out line, at least a part of the gas discharge line, and at least a part of the sealing gas supply line are disposed at positions overlapping each other in the axial direction.

9. The compressor according to claim 1, wherein the first sealing portion includes a plurality of seals separated from each other in the axial direction.

* * * * *